US012011125B2

(12) United States Patent
Okpu

(10) Patent No.: US 12,011,125 B2
(45) Date of Patent: Jun. 18, 2024

(54) ELECTRONIC FLUID APPLICATING DEVICE

(71) Applicant: Patrick Okpu, Round Lake Beach, IL (US)

(72) Inventor: Patrick Okpu, Round Lake Beach, IL (US)

( * ) Notice: Subject to any disclaimer, the term of this patent is extended or adjusted under 35 U.S.C. 154(b) by 86 days.

(21) Appl. No.: 17/748,830

(22) Filed: May 19, 2022

(65) Prior Publication Data

US 2023/0371757 A1 Nov. 23, 2023

(51) Int. Cl.
*A45D 34/04* (2006.01)
*A47K 7/04* (2006.01)

(52) U.S. Cl.
CPC ..... *A47K 7/04* (2013.01); *A45D 34/041* (2013.01)

(58) Field of Classification Search
CPC ..... A45D 34/041; A45D 2200/1081
USPC ..... 401/6, 218, 188 R
See application file for complete search history.

(56) References Cited

U.S. PATENT DOCUMENTS 6,170,108 B1 1/2001 Knight
D484,314 S 12/2003 DiGioia
6,726,385 B1 4/2004 Borowski
7,435,029 B1 * 10/2008 Marini ..... A01K 13/003 401/188 R
8,347,443 B1 1/2013 Conrad
8,888,395 B1 11/2014 Hinnant
9,055,845 B1 6/2015 Hooper
10,653,279 B2 5/2020 Wright
11,110,486 B2 * 9/2021 Gavriely ..... A61M 35/003
11,229,270 B2 * 1/2022 Kuo ..... A45D 27/02
11,272,775 B1 * 3/2022 Kizzee ..... A45D 34/04
11,533,979 B1 * 12/2022 Rehan ..... A46B 11/0006
2021/0282525 A1 * 9/2021 Kuo ..... B26B 21/446

* cited by examiner

*Primary Examiner* — Jennifer C Chiang

(57) ABSTRACT

An electronic fluid applicating device for applying fluid to and spreading the fluid over a user includes a tube coupled to a handle, the tube defining a channel. An applicator is rotationally coupled to the tube. The applicator includes a cavity and a dispensing nozzle extending from the cavity to an outer surface. The cavity is fluidically coupled to the channel and the dispensing nozzle, and the dispensing nozzle is configured to dispense a fluid. The applicator is configured to rotate and spread the fluid over the user when the outer surface of the applicator frictionally engages a user and the fluid while the fluid covers the user. A pump is fluidically coupled to the channel and is positioned such that the pump is configured for compelling the fluid from a fluid source serially through the channel, the cavity of the applicator, and the dispensing nozzle.

1 Claim, 5 Drawing Sheets

ELECTRONIC FLUID APPLICATING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to fluid applicators and more particularly pertains to a new fluid applicator for applying fluid to and spreading the fluid over a user.

(2) Description of Related Art Including Information Disclosed Under 37 CFR 1.97 and 1.98

The prior art relates to a variety of fluid applicators. Some of these dispense fluid through stationary orifices and include separate members for scrubbing or massaging. Some dispense fluid by forcing it through cavities of a porous material. However, the prior art does not relate to dispensing fluid through nozzles dispersed across a rolling applicator, wherein the applicator is then movable by a user to spread the fluid across a surface in a rolling motion.

BRIEF SUMMARY OF THE INVENTION

An embodiment of the disclosure meets the needs presented above by generally comprising a tube coupled to a handle, the tube defining a channel. An applicator is rotationally coupled to the tube. The applicator includes a cavity and a dispensing nozzle extending from the cavity to an outer surface. The cavity is fluidically coupled to the channel and the dispensing nozzle, and the dispensing nozzle is configured to dispense a fluid. The applicator is configured to rotate when the outer surface of the applicator frictionally engages a user and to spread the fluid over the user when the outer surface of the applicator frictionally engages the fluid while the fluid covers the user. A pump is fluidically coupled to the channel and is positioned such that the pump is configured for compelling the fluid from a fluid source serially through the channel, the cavity of the applicator, and the dispensing nozzle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
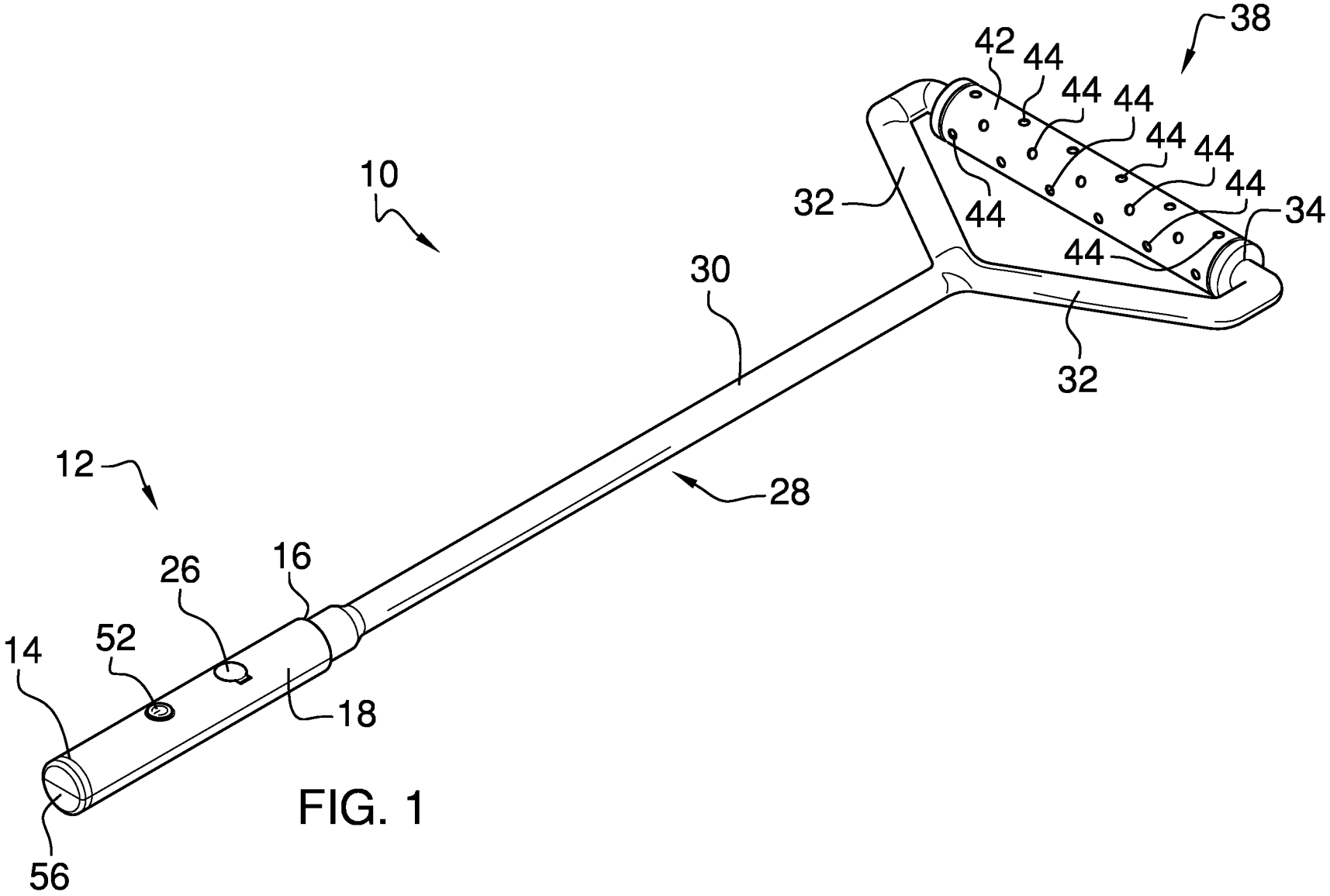
FIG. 1 is an isometric view of an electronic fluid applicating device according to an embodiment of the disclosure.
Figure 2:
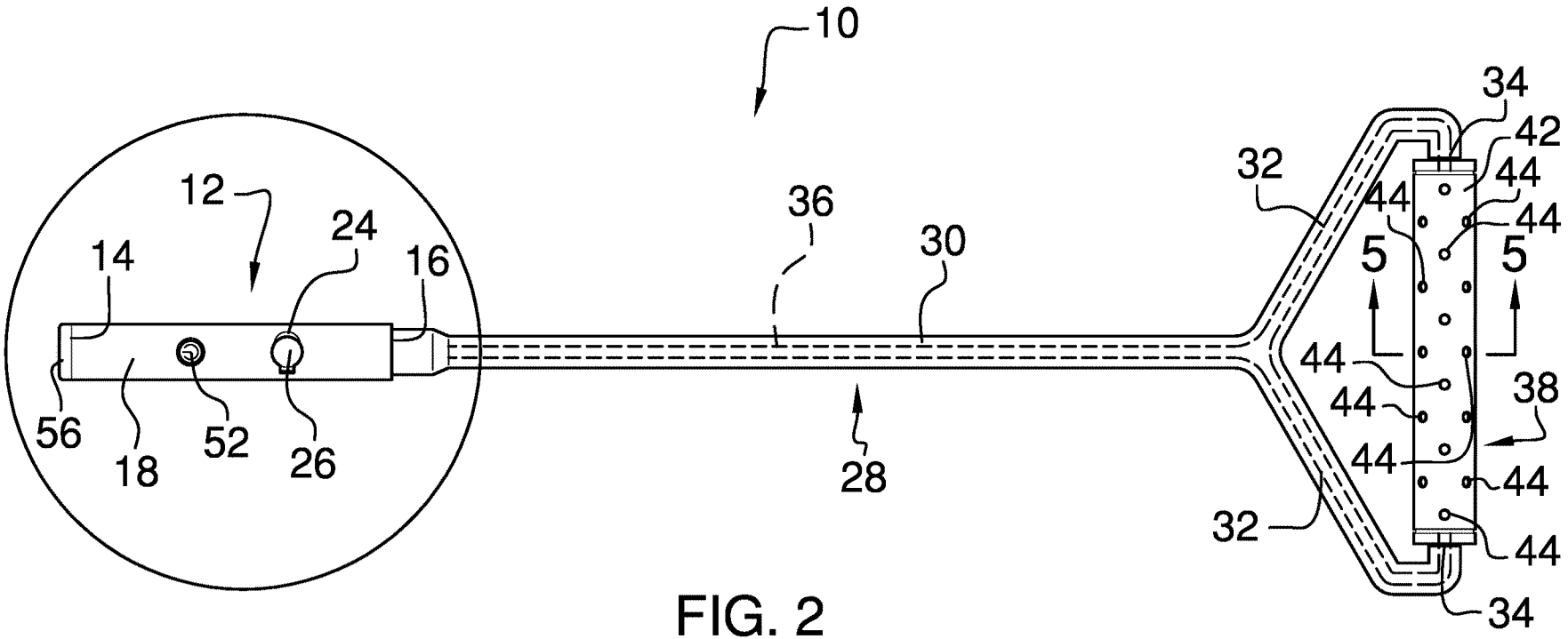
FIG. 2 is a front view of an embodiment of the disclosure.
Figure 3:
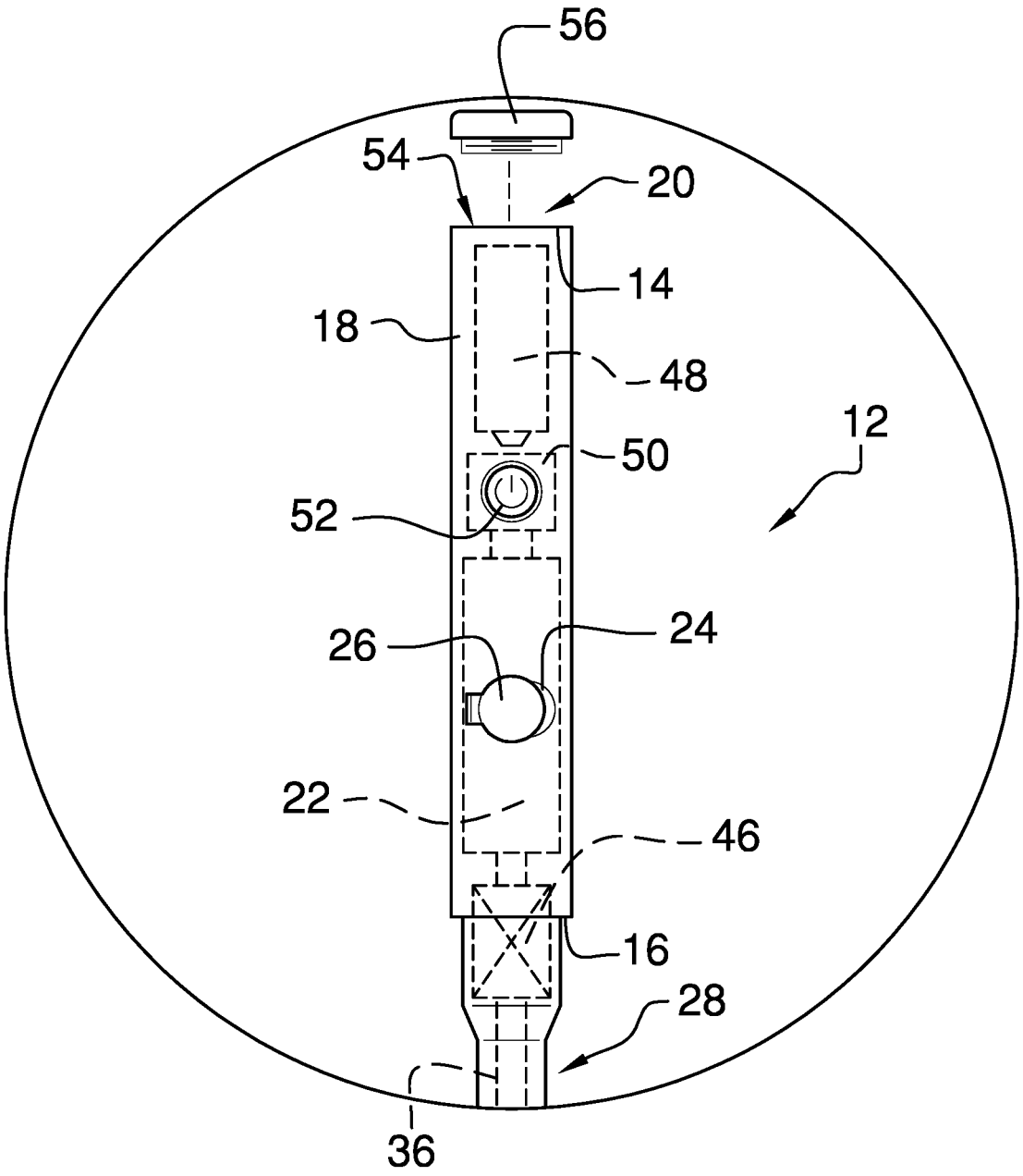
FIG. 3 is a detail view of the handle of an embodiment of the disclosure.
Figure 4:
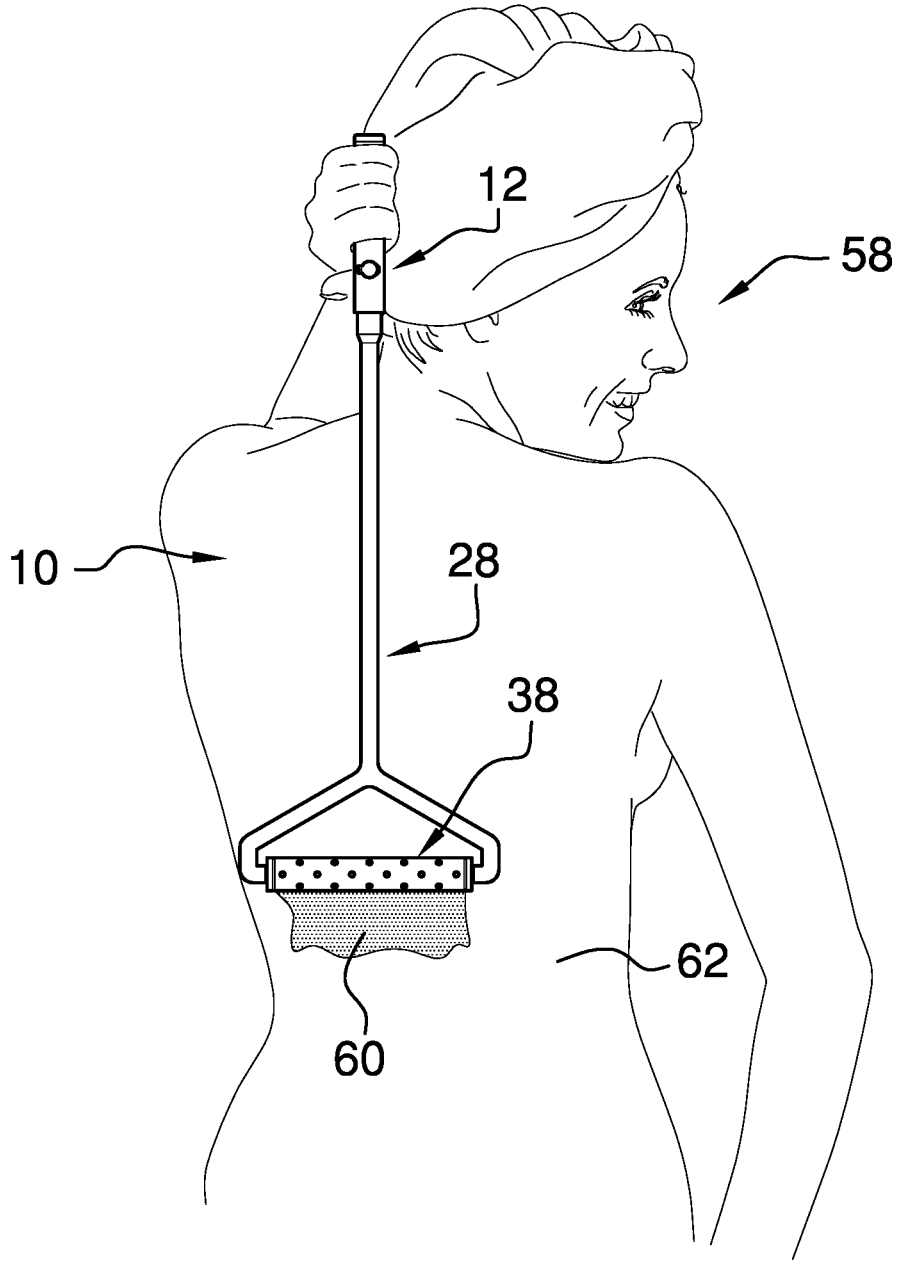
FIG. 4 is an in-use view of an embodiment of the disclosure.
Figure 5:
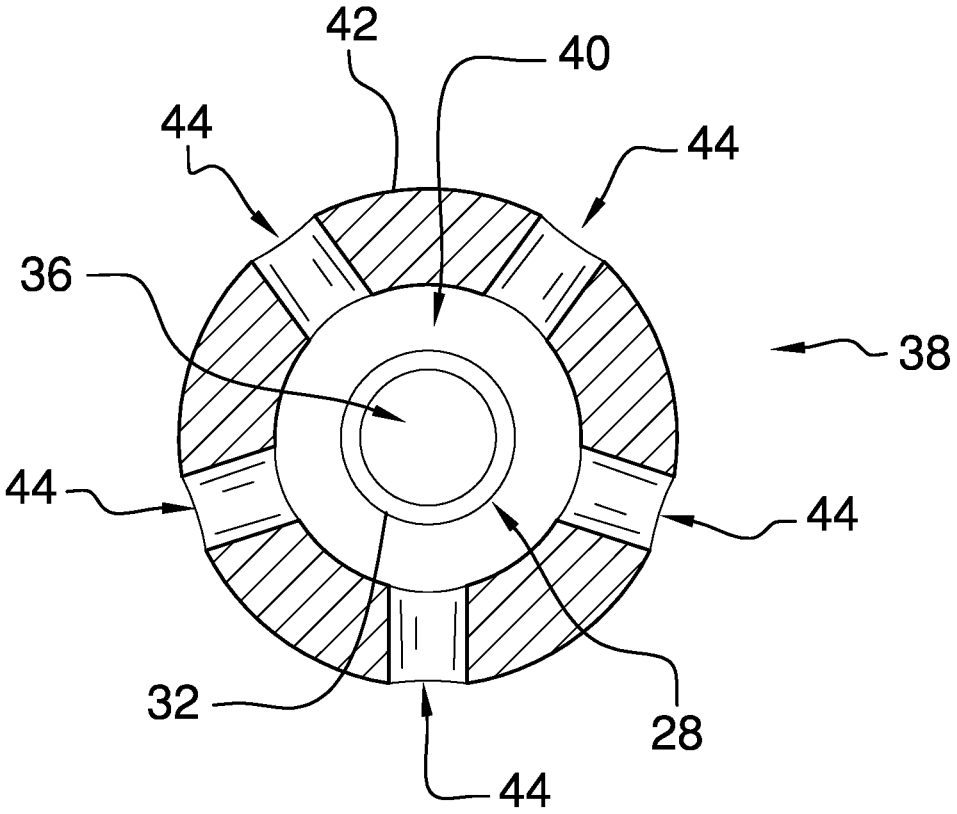
FIG. 5 is a cross-sectional view of the applicator of an embodiment of the disclosure in the direction of arrows 5-5 in FIG. 3.

With reference now to the drawings, and in particular to FIGS. 1 through 6 thereof, a new fluid applicator embodying the principles and concepts of an embodiment of the disclosure and generally designated by the reference numeral 10 will be described.

As best illustrated in FIGS. 1 through 5, the electronic fluid applicating device 10 generally comprises a handle 12 elongated from a first end 14 to a second end 16. The handle 12 has a substantially cylindrical wall 18 extending from the first end 14 to the second end 16, wherein the wall 18 defines an internal space 20. The handle 12 may be constructed of plastic or like material. A fluid compartment 22 is positioned within the internal space 20 of the handle 12 such that the fluid compartment 22 is configured for containing a fluid 60. The fluid 60 could be a lotion, cream, ointment, or any fluid 60 a user 58 may want to topically apply to the user's 58 body 62. A port 24 is positioned through the wall 18 of the handle 12 such that the port 24 opens into the fluid compartment 22. The port 24 is positioned in the handle 12 such that the port 24 is configured for inserting the fluid 60 into the fluid compartment 22. A port cap 26 complementary in shape to the port 24 is pivotably coupled to the handle 12. The port cap 26 is pivotable between a closed position and an open position such that the port 24 is closed when the port cap 26 is in the closed position and the port 24 is open when the port cap 26 is in the open position.

A tube 28 includes a trunk section 30 and a pair of branch sections 32. The trunk section 30 is coupled to the second end 16 of the handle 12 and extends from the second end 16 of the handle 12 to the pair of branch sections 32. Each branch section 32 has a distal end 34 relative to the trunk section 30. The distal ends 34 oppose each other across an applicator axis. The tube 28 defines a channel 36 extending from the second end 16 of the handle 12 to each distal end 34. The tube 28 may be constructed of plastic or like material.

An applicator 38 elongates across the applicator axis between the branch sections 32. The applicator 38 is rotationally coupled to the tube 28 about the applicator axis and includes a cavity 40 extending along the applicator axis which is fluidically coupled to the channel 36. The applicator 38 has a substantially cylindrical outer surface 42 and has a central longitudinal axis which is colinear with the applicator axis. The applicator 38 includes a plurality of dispensing nozzles 44 extending from the cavity 40 to the outer surface 42 and fluidically coupled to the cavity 40. The dispensing nozzles 44 are configured to dispense the fluid 60. The applicator 38 is configured to rotate when the outer surface 42 of the applicator 38 frictionally engages a user 58 and is configured to spread the fluid 60 over the user 58 when the outer surface 42 of the applicator 38 frictionally engages the fluid 60 while the fluid 60 covers the user 58. The applicator 38 may be constructed of metal or like material. Additionally, an applicator cover may encase the applicator 38, the applicator cover having a plurality of holes that allow fluid 60 to flow from the plurality of dispensing nozzles 44 to the user 58. The applicator cover may be constructed of polymer foam or like material.

A pump 46 is fluidically coupled to the fluid compartment 22 and the channel 36. The pump 46 is positioned within the internal space 20 of the handle 12 such that the pump 46 is configured for compelling the fluid 60 from the fluid compartment 22 serially through the channel 36, the cavity 40 of the applicator 38, and the plurality of dispensing nozzles 44. A power module 48 is positioned within the internal space 20 of the handle 12 and comprises a battery. The power module 48 is selectively operationally couplable to the pump 46. A controller 50 is operationally coupled to the pump 46 and the power module 48. The controller 50 is positioned for selectively coupling the pump 46 to the power module 48 such that the pump 46 is configured for compelling the fluid 60 from the fluid compartment 22 serially through the channel 36, the cavity 40 of the applicator 38, and the plurality of dispensing nozzles 44 when the power module 48 is operationally coupled to the pump 46. The controller 50 comprises a depressible button 52. The controller 50 selectively couples the pump 46 to the power module 48 when the button 52 is depressed such that the pump 46 is activated. The button 52 is positioned on the handle 12.

An orifice 54 extends the first end 14 of the handle 12 and is positioned in the handle 12 such that the orifice 54 is configured for servicing the power module 48. The orifice 54 is internally threaded. An orifice cap 56 is complementary in shape to the orifice 54 and is removably couplable to the handle 12 for selectively opening and closing the orifice 54.

In use, the user 58 presses the button 52 to activate the pump 46, which compels the fluid 60 through the dispensing nozzles 44. As the user 58 moves the device 10 while the applicator 38 frictionally engages the user 58, the applicator 38 rolls the fluid 60 over the user 58.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An electronic fluid applicating device comprising:

a handle elongated from a first end to a second end, said handle having a substantially cylindrical wall extending from said first end to said second end, said wall defining an internal space;

a fluid compartment positioned within said internal space of said handle, said fluid compartment being configured for containing a fluid;

a port positioned through said wall of said handle, said port opening into said fluid compartment, said port being positioned in said handle such that said port is configured for inserting the fluid into said fluid compartment;

a port cap complementary in shape to said port and pivotably coupled to said handle, said port cap being pivotable between a closed position and an open position such that said port is closed when said port cap is in said closed position and said port is open when said port cap is in said open position;

a tube including a trunk section and a pair of branch sections, said trunk section being coupled to said second end of said handle, said trunk section extending from said second end of said handle to said pair of branch sections, each said branch section having a distal end relative to said trunk section, said distal ends opposing each other across an applicator axis, said tube defining a channel extending from said second end of said handle each said distal end;

an applicator elongated across said applicator axis between said branch sections, said applicator being rotationally coupled to said tube about said applicator axis, said applicator including a cavity extending along said applicator axis, said cavity being fluidically coupled to said channel, wherein said applicator has a substantially cylindrical outer surface, said outer surface having a central longitudinal axis which is colinear with said applicator axis, wherein said applicator includes a plurality of dispensing nozzles extending fully from said cavity to said outer surface, said plurality of dispensing nozzles being fluidically coupled to said cavity, said plurality of dispensing nozzles being configured to dispense the fluid, wherein said applicator is configured to rotate when said outer surface of said applicator frictionally engages a user, wherein said applicator is configured to spread the fluid over the user when said outer surface of said applicator frictionally engages the fluid while the fluid covers the user;

a pump, said pump being fluidically coupled to said fluid compartment and said channel, said pump being positioned within said internal space of said handle such that said pump is configured for compelling the fluid from said fluid compartment serially through said channel, said cavity of said applicator, and said plurality of dispensing nozzles;

a power module positioned within said internal space of said handle, said power module comprising a battery, said power module being selectively operationally couplable to said pump;

a controller operationally coupled to said pump and said power module, said controller being positioned for selectively coupling said pump to said power module, said pump being configured for compelling the fluid from said fluid compartment, serially through said channel, said cavity of said applicator, and said plurality of dispensing nozzles when said power module is operationally coupled to said pump, wherein said controller comprises a button, said button being depressible, said controller selectively coupling said pump to said power module wherein said pump is activated when said button is depressed, said button being positioned on said handle;

an orifice through said first end of said handle, said orifice being positioned in said handle such that said orifice is configured for servicing said power module, said orifice being internally threaded; and an orifice cap complementary in shape to said orifice, said cap being removably couplable to said handle for selectively opening and closing said orifice.

* * * * *